US005338918A

United States Patent [19]

Eshleman

[11] Patent Number: 5,338,918

[45] Date of Patent: Aug. 16, 1994

[54] HEAT GENERATOR ASSEMBLY IN A MATERIAL PROCESSING APPARATUS

[76] Inventor: Roger D. Eshleman, 506 Clayton Ave., Waynesboro, Pa. 17268

[21] Appl. No.: 987,936

[22] Filed: Dec. 9, 1992

[51] Int. Cl.[5] ..... F27D 11/02

[52] U.S. Cl. ..... 219/411; 219/405; 219/553; 219/541

[58] Field of Search ..... 219/405, 411, 539, 541, 219/542, 552, 553; 392/425, 423, 424, 500, 501

[56] References Cited

U.S. PATENT DOCUMENTS

| | | | |
|---|---|---|---|
| 2,616,021 | 10/1952 | O'Brien | 392/423 |
| 2,981,819 | 4/1961 | Gregory | 219/405 |
| 2,986,594 | 5/1961 | Ireland | 219/542 |
| 3,300,566 | 1/1967 | Walker | 219/541 |
| 4,179,603 | 12/1979 | Zeigler | 219/552 |
| 4,206,186 | 6/1980 | Holter et al. | 423/230 |
| 4,495,873 | 1/1985 | Blankenship | 110/250 |
| 4,503,319 | 3/1985 | Moritoki | 219/553 |
| 4,513,671 | 4/1985 | Eshleman | 110/101 CF |
| 4,531,464 | 7/1985 | Eshleman | 110/259 |
| 4,598,649 | 7/1986 | Eshleman | 110/211 |
| 4,599,141 | 7/1986 | Shultz | 201/2.5 |
| 4,635,899 | 1/1987 | Eshleman | 251/298 |
| 4,759,300 | 7/1988 | Hansen et al. | 110/229 |
| 4,802,424 | 2/1989 | McGinnis, III et al. | 110/250 |
| 4,924,785 | 5/1990 | Schultz et al. | 110/346 |
| 4,934,283 | 6/1990 | Kydd | 110/246 |
| 4,949,652 | 8/1990 | Hadley | 110/215 |
| 5,065,680 | 11/1991 | Cheetham | 110/342 |

*Primary Examiner*—Teresa J. Walberg

*Attorney, Agent, or Firm*—Michael R. Swartz; John R. Flanagan

[57] ABSTRACT

A heat generator assembly in a material processing apparatus includes a heater unit and an elongated deflector structure mounted adjacent thereto. The heater unit includes a plurality of elongated electric heating elements extending in generally parallel relation to one another and being operable for emitting heat radiation. The deflector structure is disposed along the electric heating elements and in circumferential relation partially about the electric heating elements for deflecting the heat radiation in a desired direction away from the heating elements. The heater unit also includes a pair of elongated electrically-conductive positive and negative electrodes and having spaced opposite end portions, an arrangement supporting the positive and negative electrodes and the electric heating elements in a spaced apart parallel relation to one another, and a plurality of connector elements electrically connecting selected ones of the opposite end portions of the electric heating elements with selected ones of the opposite end portions of the positive and negative electrodes so as to define at least one electrical circuit path between the positive and negative electrodes and through the electric heating elements.

15 Claims, 14 Drawing Sheets

HEAT GENERATOR ASSEMBLY IN A MATERIAL PROCESSING APPARATUS

CROSS REFERENCE TO RELATED APPLICATIONS

Reference is hereby made to the following copending U.S. applications dealing with subject matter related to the present invention:

1. "Apparatus And Method For Controlled Processing Of Materials" by Roger D. Eshleman and Paul S. Stevers, assigned U.S. Ser. No. 87/987,928 and filed Dec. 9, 1992.
2. "Multiple Unit Material Processing Apparatus" by Roger D. Eshleman, assigned U.S. Ser. No. 07/987,929 and filed Dec. 9, 1992.
3. "Casing And Heater Configuration In A Material Processing Apparatus" by Roger D. Eshleman, assigned U.S. Ser. No. 07/987,946 and filed Dec. 9, 1992

BACKGROUND OF THE INVENTION

1. Field of the Invention

The present invention generally relates to material processing and, more particularly, is concerned with a heat generator assembly in an apparatus for controlled processing of materials, such as the disposal of medical and other waste material, particularly on-site where the waste material is produced.

2. Description of the Prior Art

The problem of disposal of waste matter involves a material processing challenge that is becoming increasingly acute. The primary material processing methods of waste disposal have been burning in incinerators and burial in landfills. These two material processing methods have severe disadvantages. Burning of waste liberates particulate matter and fumes which contribute to pollution of the air. Burial of wastes contributes to the contamination of ground water. A third material processing method is recycling of waste. Although increasing amounts of waste are being recycled, which alleviates the problems of the two primary material processing methods, presently available recycling methods do not provide a complete solution to the waste disposal problem.

The problem of disposal of biomedical waste materials is even more acute. The term "biomedical waste materials" is used herein in a generic sense to encompass all waste generated by medical hospitals, laboratories and clinics which may contain hazardous, toxic or infectious matter whose disposal is governed by more stringent regulations than those covering other waste. It was reported in *The Wall Street Journal* in 1989 that about 13,000 tons a day of biomedical waste, as much as 20% of it infectious, is generated by around 6,800 U.S. hospitals.

Hospitals and other generators of biomedical waste materials have employed three main material processing methods of waste handling and disposal (1) on-site incineration with only the residue transferred to landfills; (2) on-site steam autoclaving followed by later transfer of the waste to landfills; and (3) transfer of the waste by licensed hazardous waste haulers to off-site incinerators and landfills. Of these three main material processing methods, theoretically at least, on-site disposal is the preferred one.

However, many hospital incinerators, being predominantly located in urban areas, emit pollutants at a relatively high rate which adversely affect large populations of people. In the emissions of hospital incinerators, the Environmental Protection Agency (EPA) has identified harmful substances, including metals such as arsenic, cadmium and lead; dioxins and furans; organic compounds like ethylene, acid gases and carbon monoxide; and soot, viruses, and pathogens. Emissions of these incinerators may pose a public health threat as large as that from landfills.

Nonetheless, on-site disposal of biomedical waste materials still remains the most promising solution. One recent on-site waste disposal unit which addresses this problem is disclosed in U.S. Pat. No. 4,934,283 to Kydd. This unit employs a lower pyrolyzing chamber and an upper oxidizing chamber separated by a movable plate. The waste material is deposited in the lower chamber where it is pyrolyzed in the absence of air and gives off a combustible vapor that, in turn, is oxidized in the upper chamber. While this unit represents a step in the right direction, it does not appear to approach an optimum solution to the problem of biomedical waste material disposal.

SUMMARY OF THE INVENTION

The present invention provides a heat generator apparatus in a material processing apparatus designed to satisfy the aforementioned needs. While the heat generator apparatus of the present invention can be used in different applications, it is primarily useful in an apparatus for waste disposal and particularly in an apparatus for disposing biomedical waste material on-site where the waste material is produced. A greater than 95% reduction in mass and volume is achieved as is the complete destruction of all viruses and bacteria. The residue is a sterile, inert inorganic powder, which is non-hazardous, nonleachable and capable of disposal as ordinary trash.

The preferred embodiment of the present invention includes various unique features for facilitating the processing material and particularly the disposing of material. Although some of these features comprise inventions claimed in other copending applications cross-referenced above, all are illustrated and described herein for facilitating a complete and thorough understanding of the features comprising the present invention.

Accordingly, the present invention is directed to a heat generator assembly in a material processing apparatus which comprises a heater unit and an elongated deflector structure mounted adjacent thereto. The heater unit includes a plurality of elongated electric heating elements extending in generally parallel relation to one another and being operable for emitting heat radiation. The defector structure is disposed along the electric heating elements and in circumferential relation partially about the electric heating elements for deflecting the heat radiation in a desired direction away from the heating elements. The heater unit also includes a pair of elongated electrically-conductive positive and negative electrodes and having spaced opposite end portions, an arrangement supporting the positive and negative electrodes and the electric heating elements in a spaced apart parallel relation to one another, and a plurality of connector elements electrically connecting selected ones of the opposite end portions of the electric heating elements with selected ones of the opposite end portions of the positive and negative electrodes so as to define at least one electrical circuit path between the positive and negative electrodes and through the electric heating elements.

These and other features and advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DETAILED DESCRIPTION OF THE INVENTION

Figure 1:
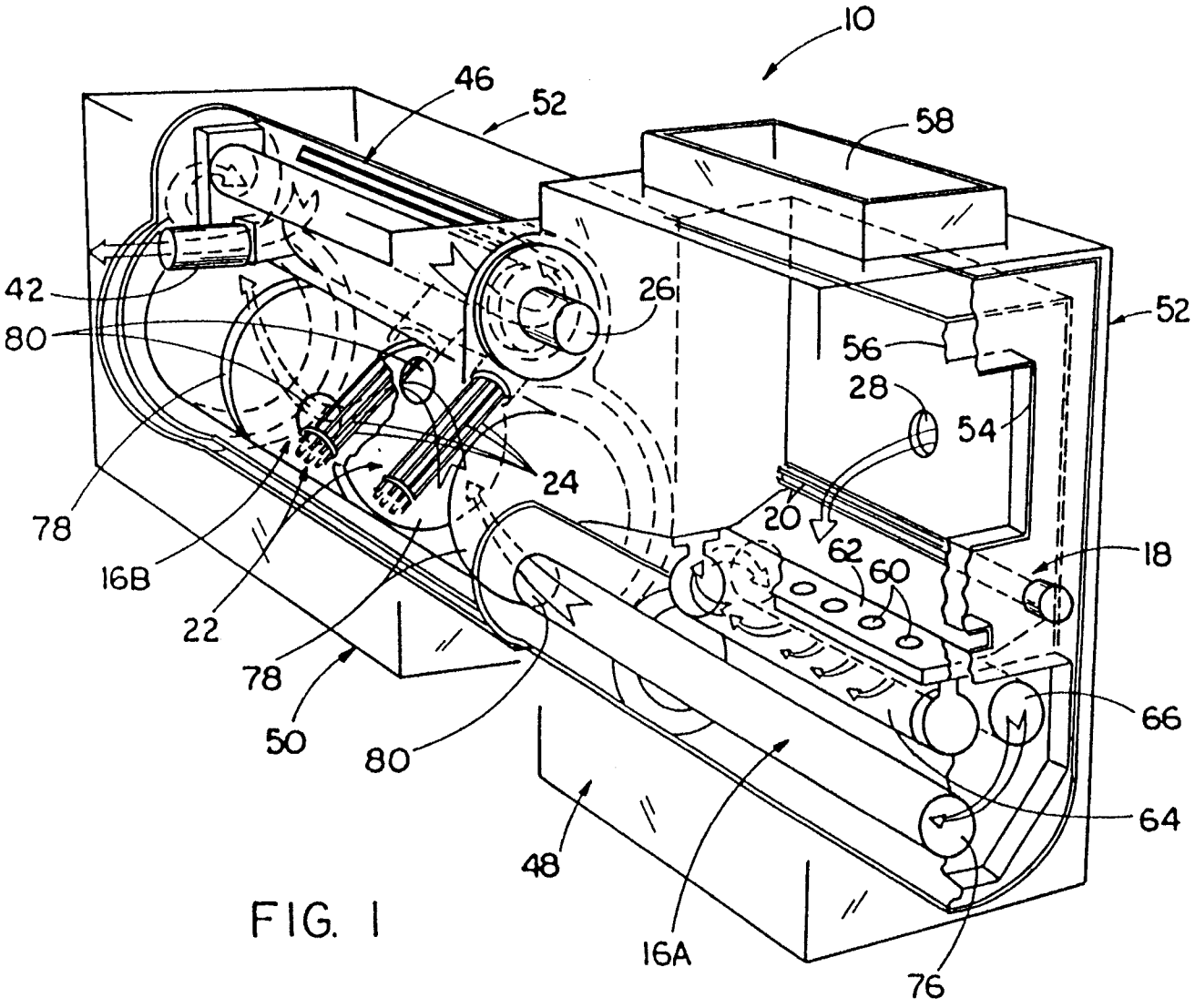
FIG. 1 is a schematical perspective view of an apparatus for controlled processing of materials including features in accordance with the present invention.
Figure 2:
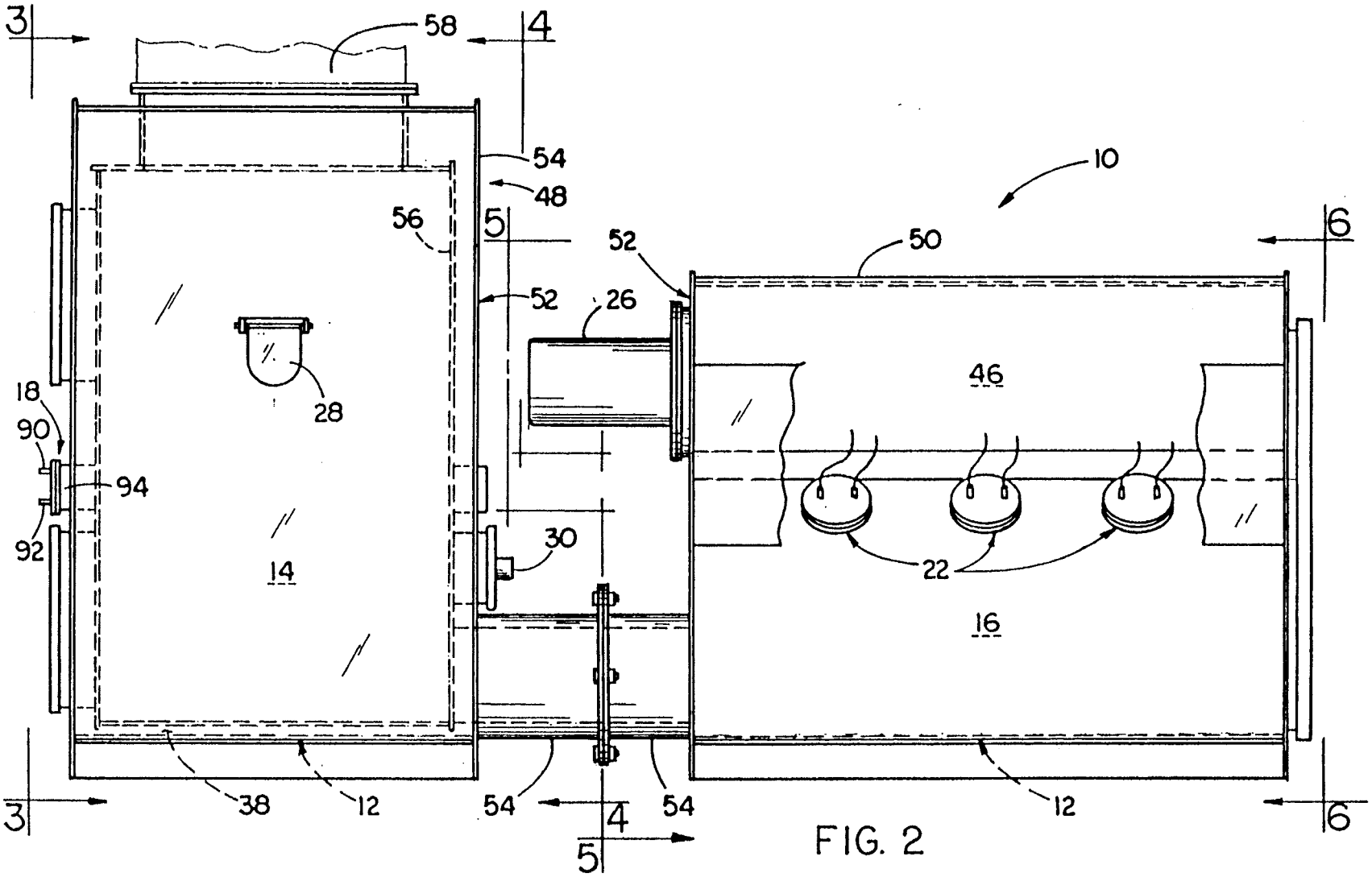
FIG. 2 is an enlarged side elevational view of the apparatus of FIG. 1, showing an opposite side from that shown in FIG. 1.
Figure 3:
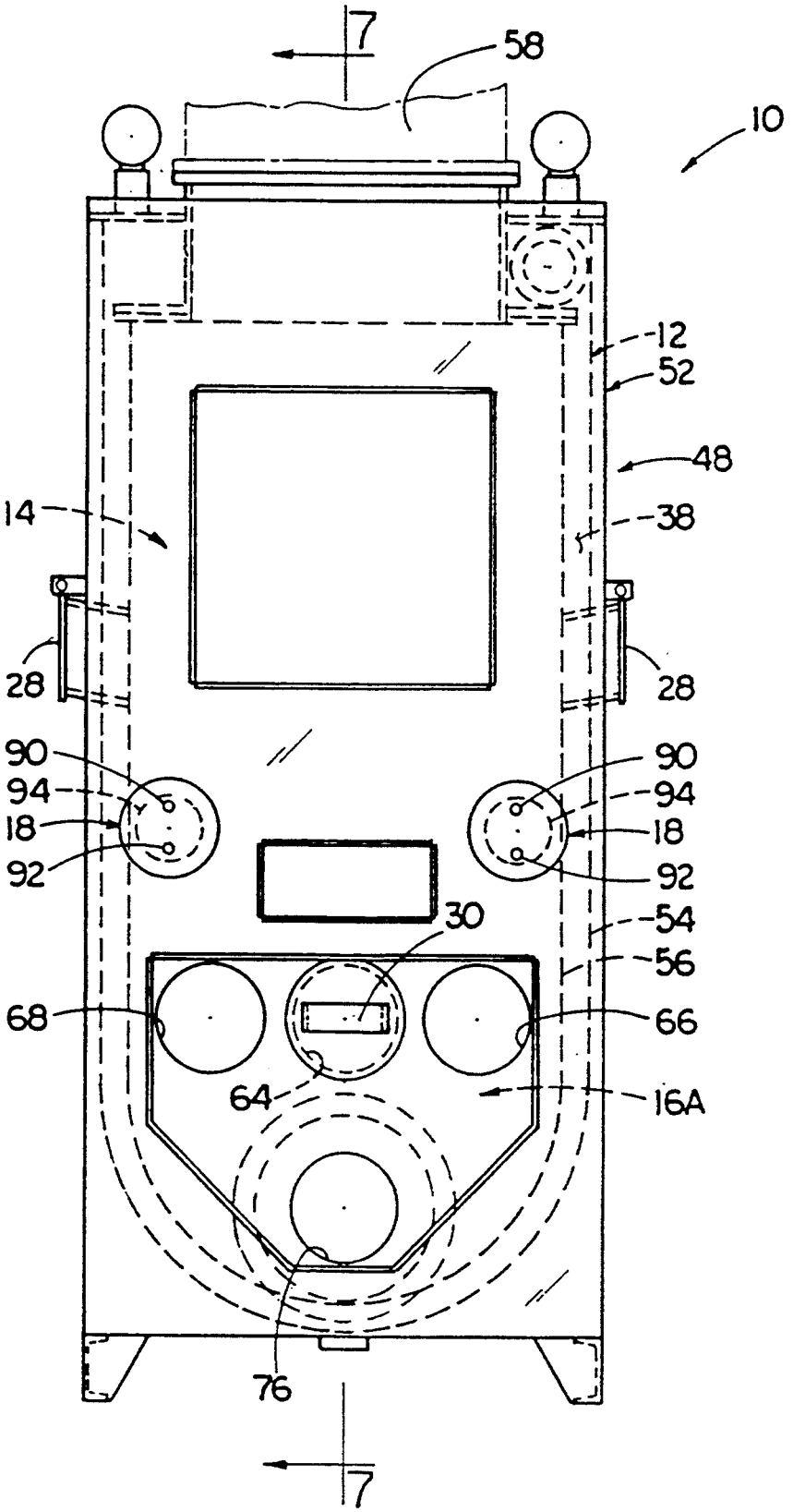
FIG. 3 is an enlarged end elevational view of a first housing unit of the apparatus as seen along line 3—3 of FIG. 2.
Figure 4:
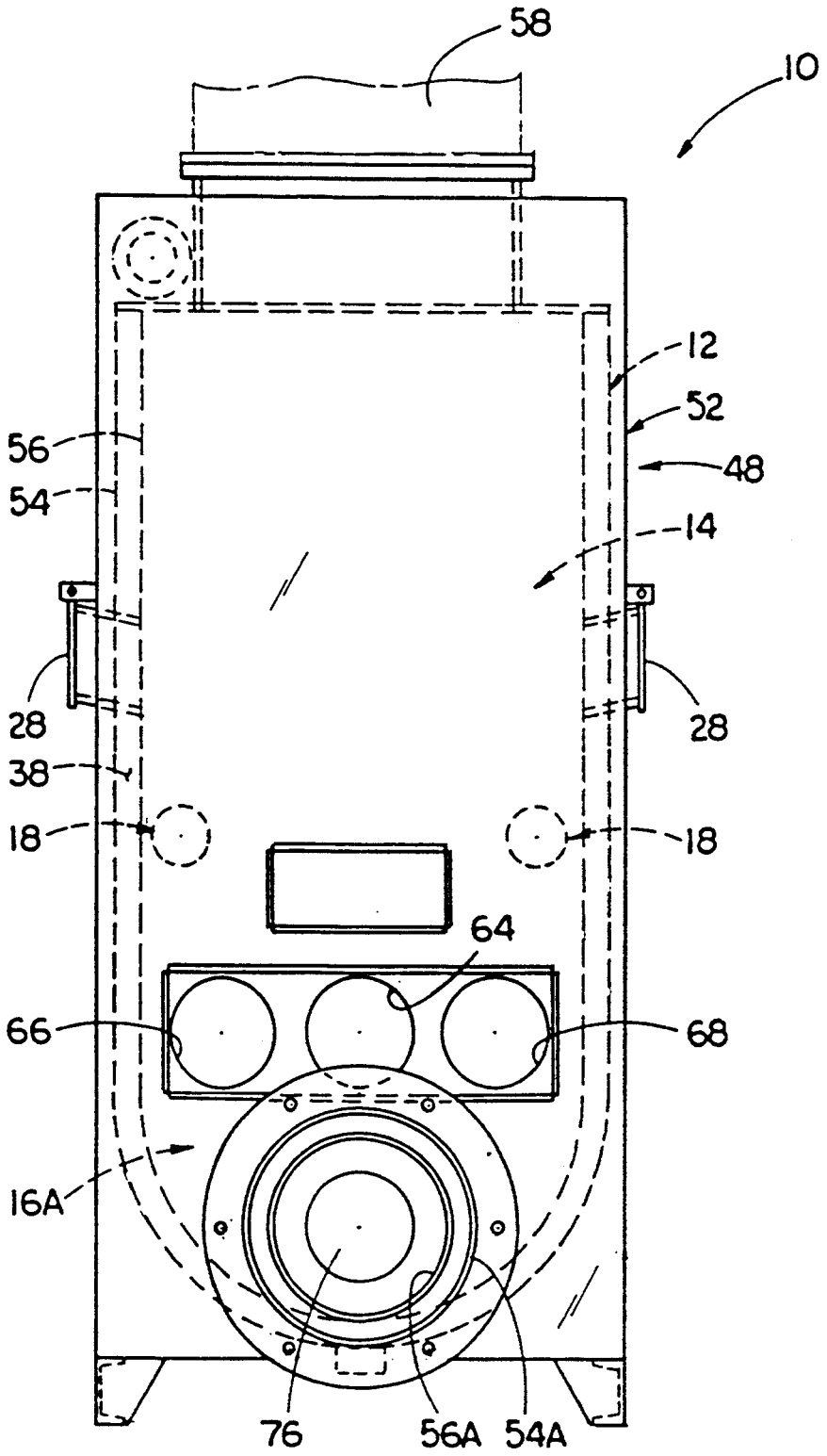
FIG. 4 is an enlarged opposite end elevational view of the first housing unit of the apparatus as seen along line 4—4 of FIG. 2.
Figure 6:
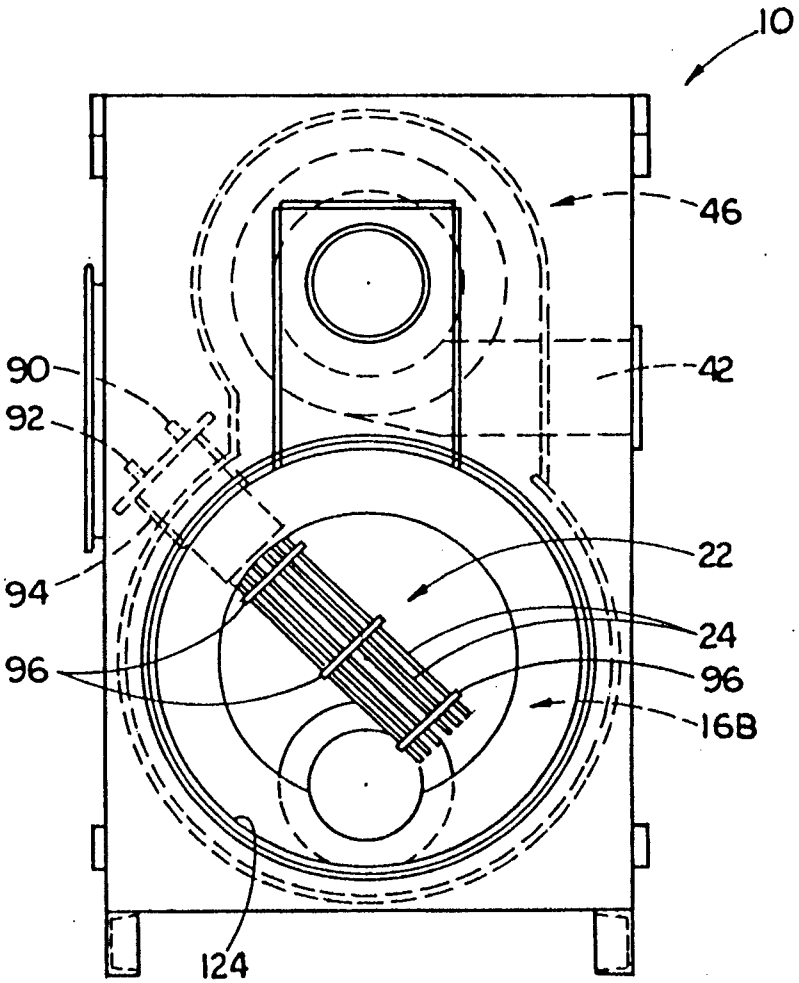
FIG. 6 is an enlarged opposite end elevational view of the second housing unit of the apparatus as seen along line 6—6 of FIG. 2.
Figure 5:
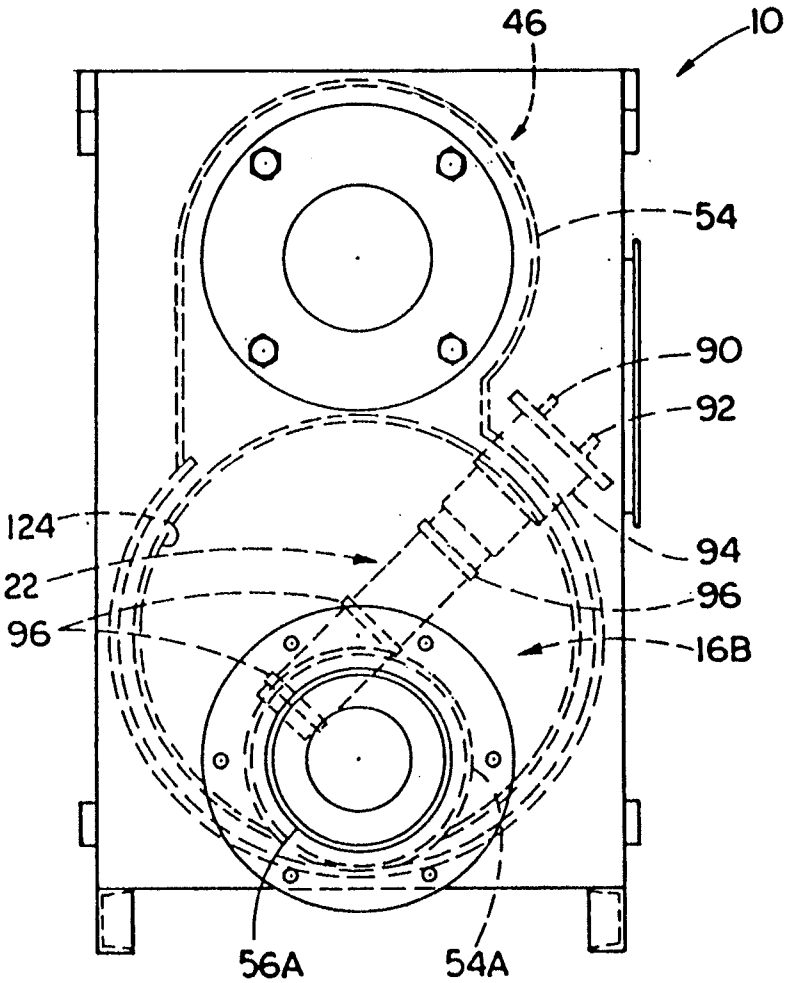
FIG. 5 is an enlarged end elevational view of a second housing unit of the apparatus as seen along line 5—5 of FIG. 2.
Figure 7:
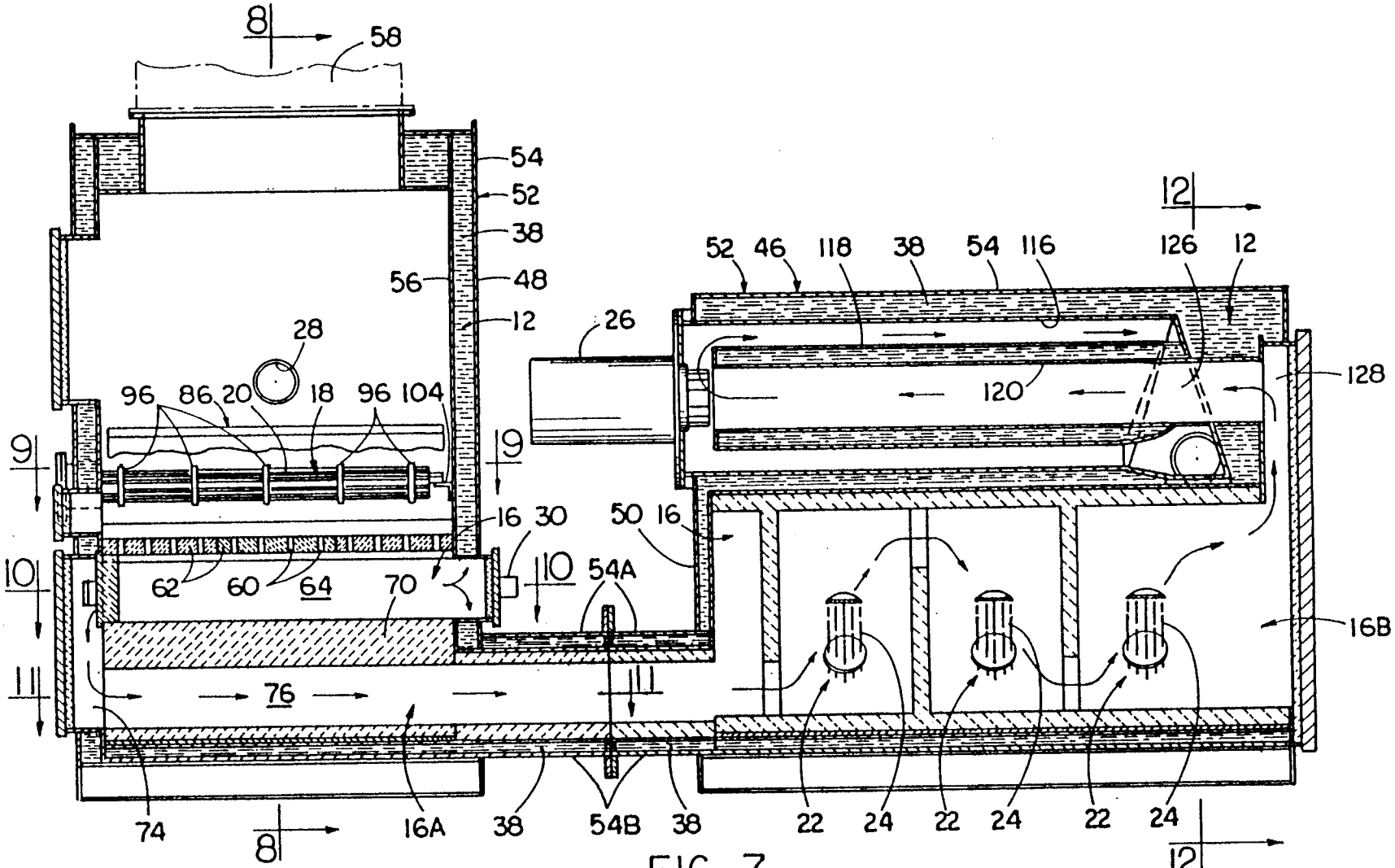
FIG. 7 is a longitudinal vertical sectional view of the apparatus taken along line 7—7 of FIG. 3.
Figure 8:
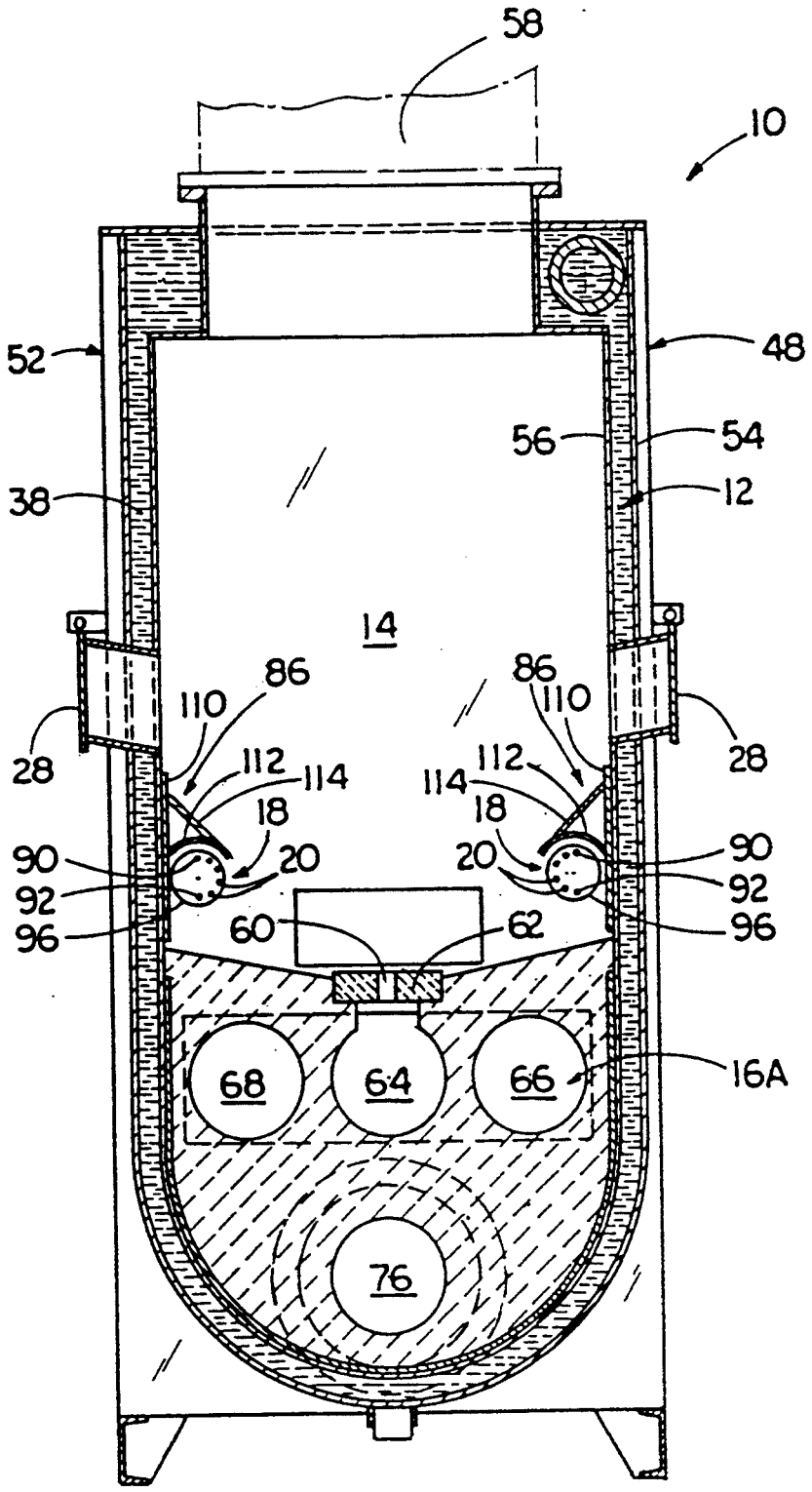
FIG. 8 is an enlarged vertical cross-sectional view of the first housing unit of the apparatus taken along line 8—8 of FIG. 7.
Figure 9:
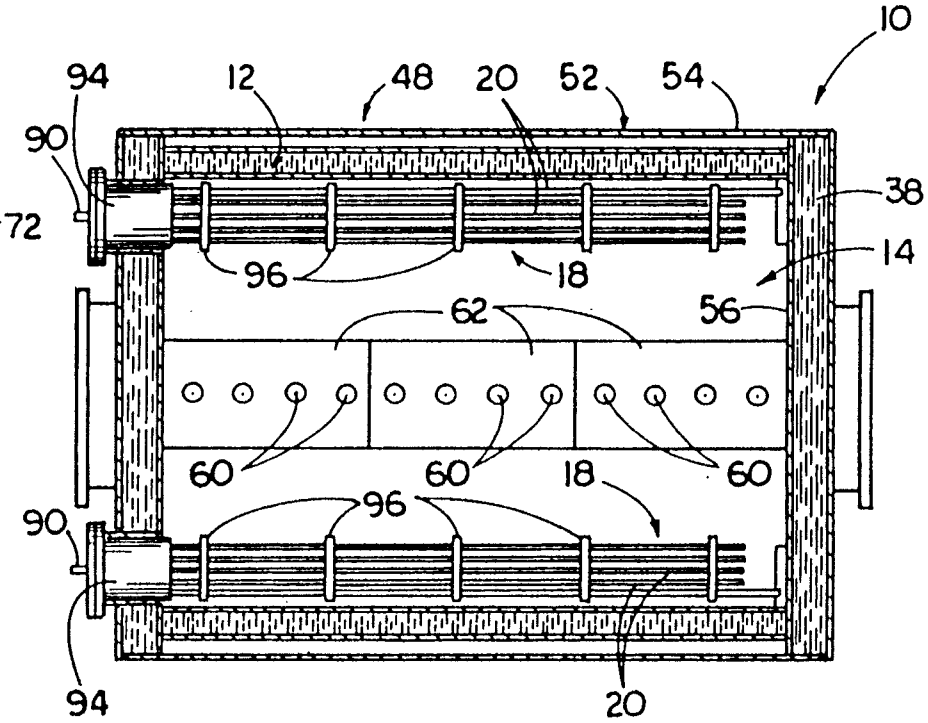
FIG. 9 is an enlarged horizontal cross-sectional view of the first housing unit of the apparatus taken along line 9—9 of FIG. 7.
Figure 10:
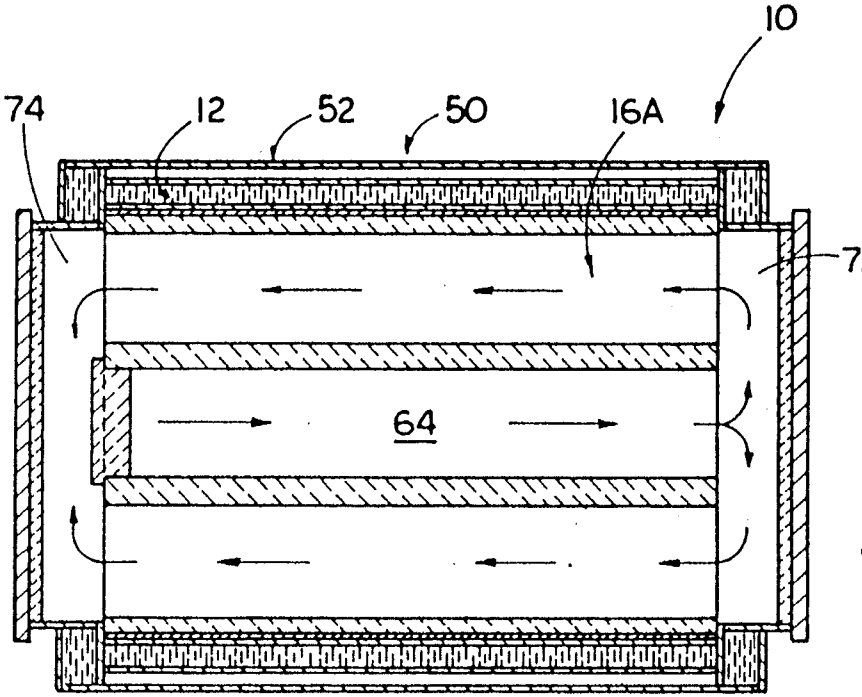
FIG. 10 is another horizontal cross-sectional view of the first housing unit of the apparatus taken along line 10—10 of FIG. 7.
Figure 12:
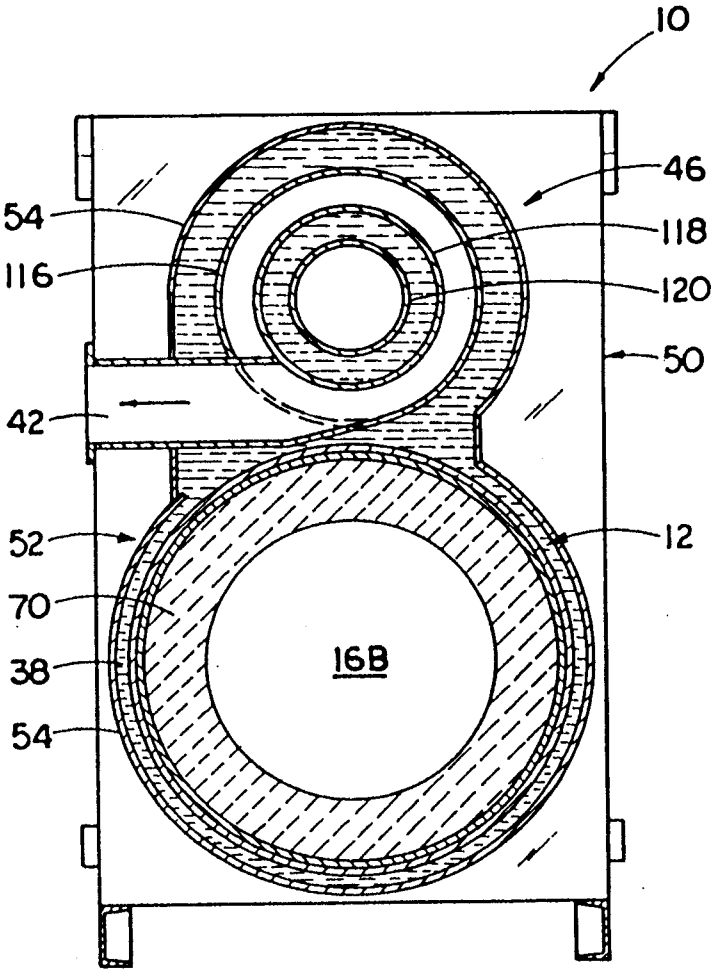
FIG. 12 is an enlarged vertical cross-sectional 15 view of the second housing unit of the apparatus taken along line 12—12 of FIG. 7.
Figure 11:
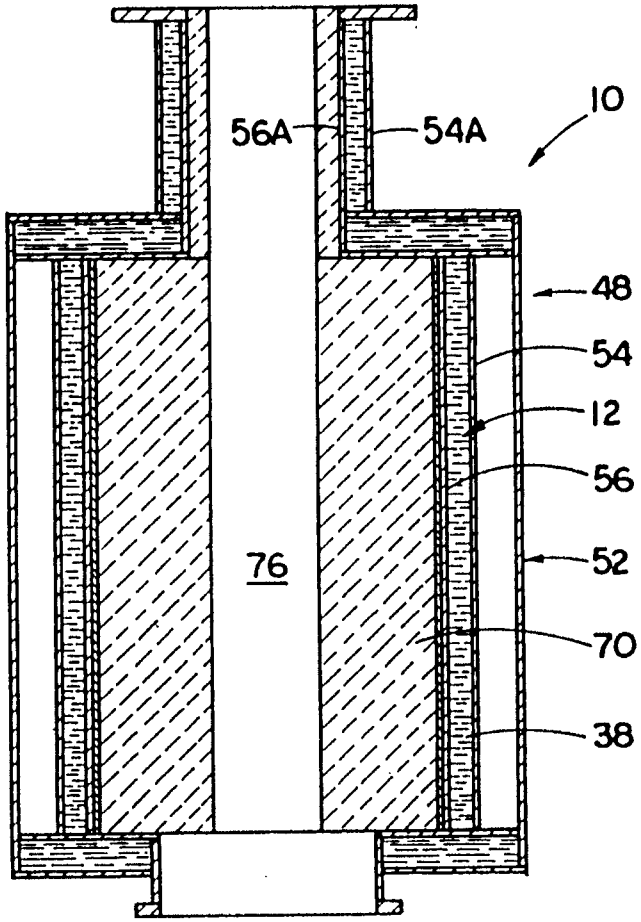
FIG. 11 is still another horizontal cross-sectional view of the first housing unit of the apparatus taken along line 11—11 of FIG. 7.
Figure 14:
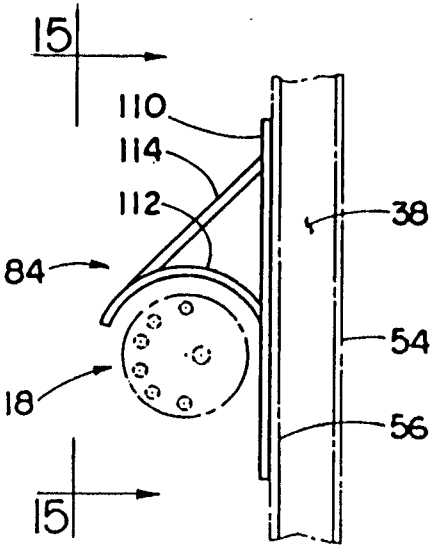
FIG. 14 is an enlarged end elevational view of a deflector device associated with each of the heating units of the first housing unit.
Figure 15:
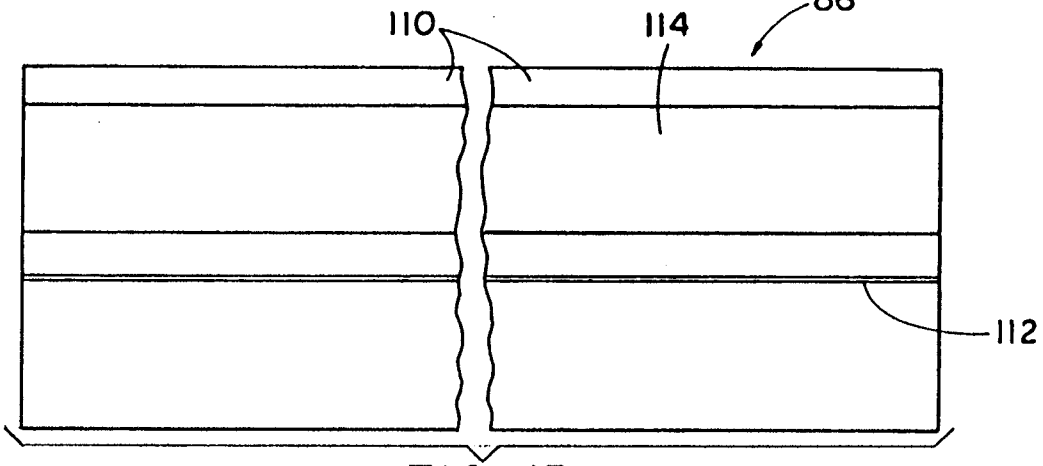
FIG. 15 is a foreshortened front elevational view of the deflector device as seen along line 15—15 of FIG. 14.
Figure 13:
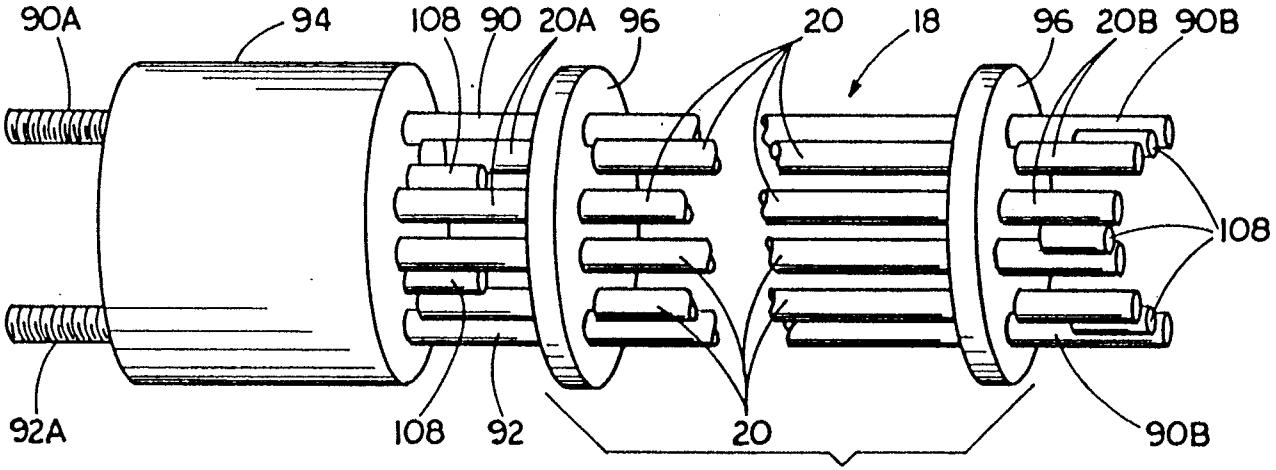
FIG. 13 is an enlarged foreshortened perspective view of one of the heating units of the apparatus shown in FIGS. 8 and 9.
Figures 16, 17, 18, 19, 20, 21:
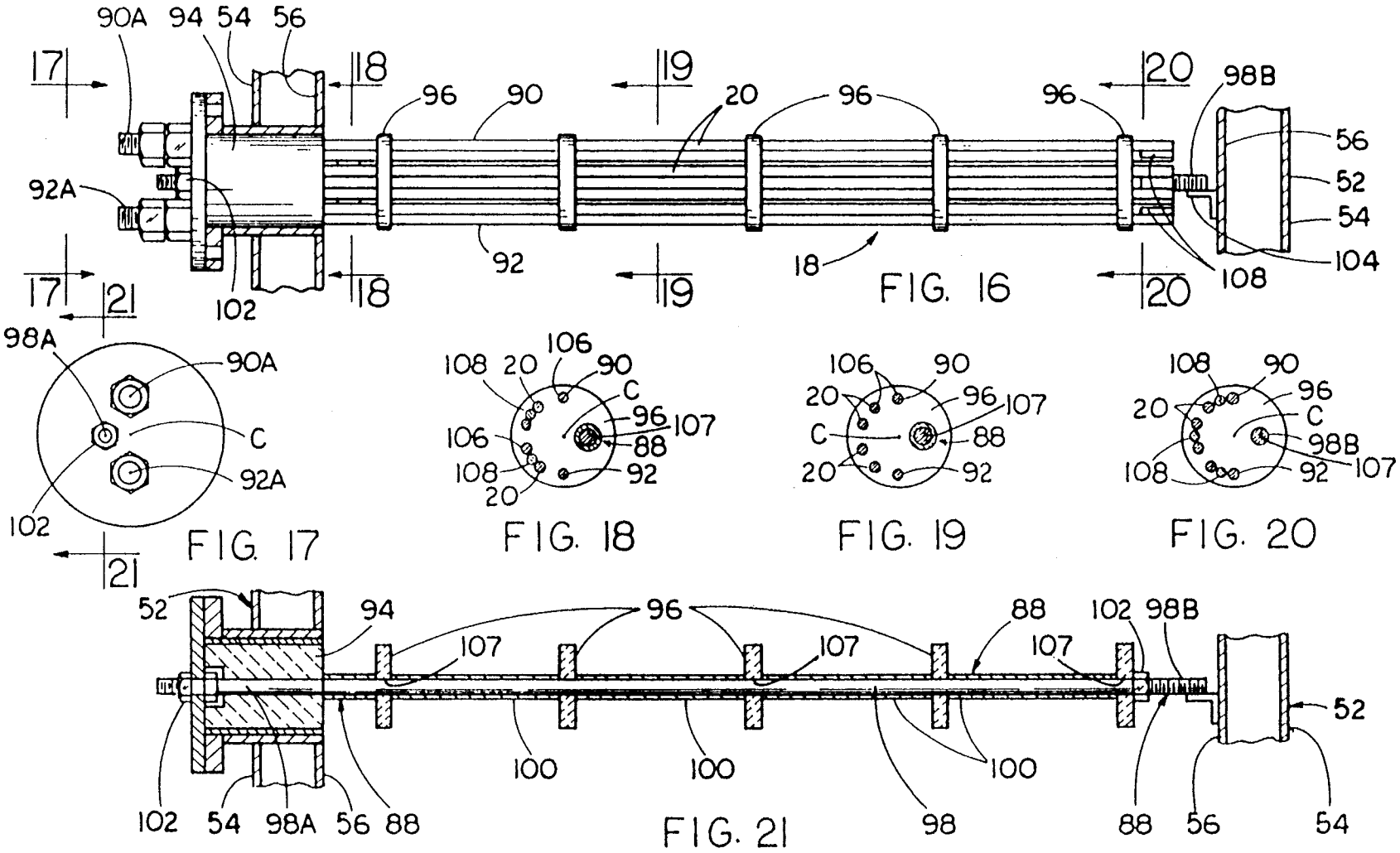
FIG. 16 is an enlarged longitudinal elevational view of one of the heating units of the apparatus shown in FIG. 9 of the first housing unit.
FIG. 17 is an end elevational view of the heating unit as seen along line 17—17 of FIG. 16.
FIG. 18 is a cross-sectional view of the heating unit taken along line 18—18 of FIG. 16.
FIG. 19 is another cross-sectional view of the heating unit taken along line 19—19 of FIG. 16.
FIG. 20 is still another cross-sectional view of the heating unit taken along line 20—20 of FIG. 16.
FIG. 21 is a longitudinal sectional view of the heating unit taken along line 21—21 of FIG. 17.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Material Processing Apparatus—In General

Referring now to the drawings, and particularly to FIGS. 1, 2, 7, 23 and 24, there is illustrated an apparatus, generally designated 10, for controlled processing of materials, and in particular for controlled disposal of biomedical waste materials, which includes features in accordance with the present invention. The material processing apparatus 10 basically includes a coolant jacketed vessel 12 defining a first pyrolysis chamber 14 and a second oxidation chamber 16. The apparatus 10 also includes one or more first heater units 18 having a plurality of elongated rod-like electric heating elements 20 mounted in the vessel 12 and being operable to electrically generate heat for pyrolyzing materials in the first chamber 14, and one or more second heater units 22 having a plurality of electric heating elements 24 mounted in the vessel 12 and being operable to electrically generate heat for oxidizing materials in the second chamber 16.

The apparatus 10 further includes an air flow generating means, preferably an induction fan 26 and a fan speed controller 27, connected in flow communication with the first and second chambers 14, 16, and first and second airflow inlet valves 28, 30 connected to the jacketed vessel 12. The apparatus also includes an air intake proportioning valve 31 connected in flow communication with the first and second air inlet valves 28, 30. The induction fan 26, proportioning valve 31, and first and second inlet valves 28, 30 function to produce separate primary and secondary variable flows of air respectively into and through the first and second chambers 14, 16. One suitable embodiment of the fan speed controller 27 is a commercially-available unit identified as GPD 503 marketed by Magnetek of New Berlin, Wis. One suitable embodiment of the valves 28, 30 is disclosed in U.S. Pat. No. 4,635,899, the disclosure of which is incorporated herein by reference thereto. One suitable embodiment of the proportioning valve 31 is a pair of conventional air intake butterfly valves controlled by a standard proportioning motor marketed by the Honeywell Corporation. The respective amounts of air in the primary and secondary flows through the first and second chambers 14, 16 are proportioned by the operation of proportioning valve 31 to separately adjust the ratio of the amounts of air flow routed to the first and second air inlet valves 28, 30. The respective amounts of air in the primary and secondary flows are correspondingly varied by varying the speed of operation of the induction fan 26.

Still further at least three temperature sensors 32, 34, 36, such as conventional thermocouples, are mounted on the vessel 12 for sensing the temperatures in the first and second chambers 14, 16 and in the coolant circulating about a channel 38 defined by the jacketed vessel 12 about the first and second chambers 14, 16. Additionally, a gas sensor 40 is mounted on a discharge outlet 42 of the vessel 12 for sensing the concentration of a predetermined gas, for example oxygen, in the discharge gases. Also, a computer-based central control system 44 (FIG. 24) is incorporated in the apparatus 10 for controlling and directing the overall operation of the apparatus 10. One suitable computer which can be employed by the control system 44 is identified as PC-55 marketed by the Westinghouse Electric Corporation of Pittsburgh, Pa.

Further, as seen in FIGS. 7, 12, 23 and 24, the apparatus 10 includes a heat exchanger 46 connected in flow communication between the second chamber 16 and the discharge outlet 42. The heat exchanger 46 functions to remove heat from and thereby cool the coolant flowing through the channel 38 defined by jacketed vessel 12. As pointed out in FIGS. 23 and 24, the heat removed by the heat exchanger 46 can be employed in other applications in the facility housing the material processing apparatus 10.

Figure 24:
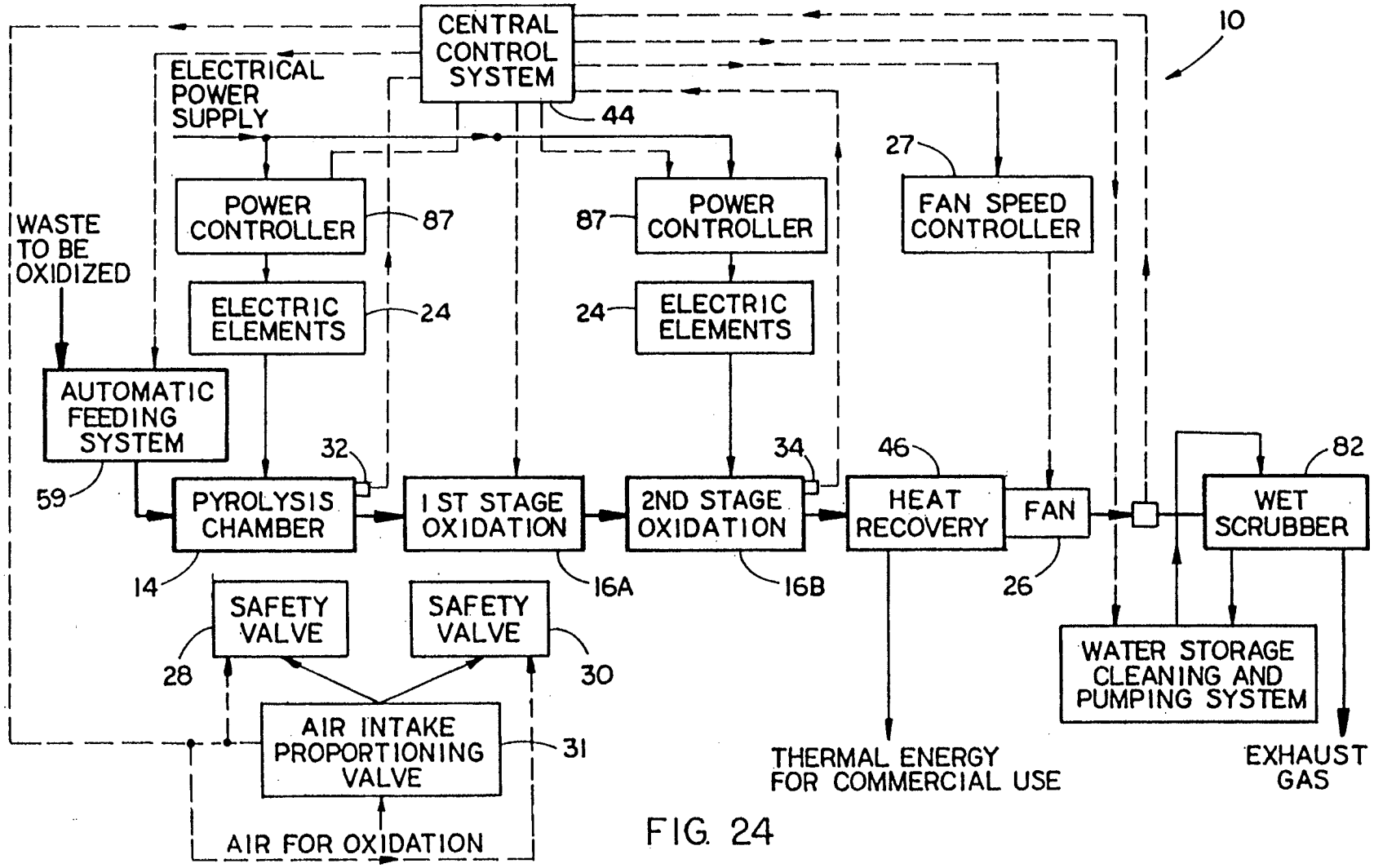
FIG. 24 is a functional block diagram of the material processing apparatus of FIG. 1.

FIG. 24 is a functional block diagram which illustrates the overall relationships between the above-described components of the material processing apparatus. FIG. 24 also illustrates the directions of interactions between the components of the apparatus 10 under the monitoring and control of its computerbased central control system 44 for effecting optimal pyrolyzing and oxidizing of the materials therein. The material processing apparatus 10 operates through one cycle to process, that is to pyrolyze and oxidize, a predetermined batch of material, such as biomedical waste material.

More particularly, the control system 44 is responsive to the temperatures sensed in the first and second chambers 14, 16 by temperature sensors 32, 34 and in the coolant circulating through the channel 38 of the jacketed vessel 12 by temperature sensor 36. The control system 44 also is responsive to the proportion of the predetermined gas, such as oxygen, sensed in the discharge gases by gas sensor 40. The control system 44, in response to these various temperatures sensed and to the proportion of oxygen sensed, operates to control the position of the air intake proportioning valve 31 so as to adjust the ratio of or proportion the amount of primary air flow to the amount of secondary air flow through the first and second inlet valves into the first and second chambers 14, 16. Also, the control system 44, in response to these various temperatures sensed and to the proportion of oxygen sensed, operates to control the operation of the induction fan 26 via the fan speed controller 27 so as to adjust the amounts (but not the proportion) of primary and secondary air flows into the first and second chambers 14, 16.

Multiple Unit Material Processing Apparatus

Figure 22:
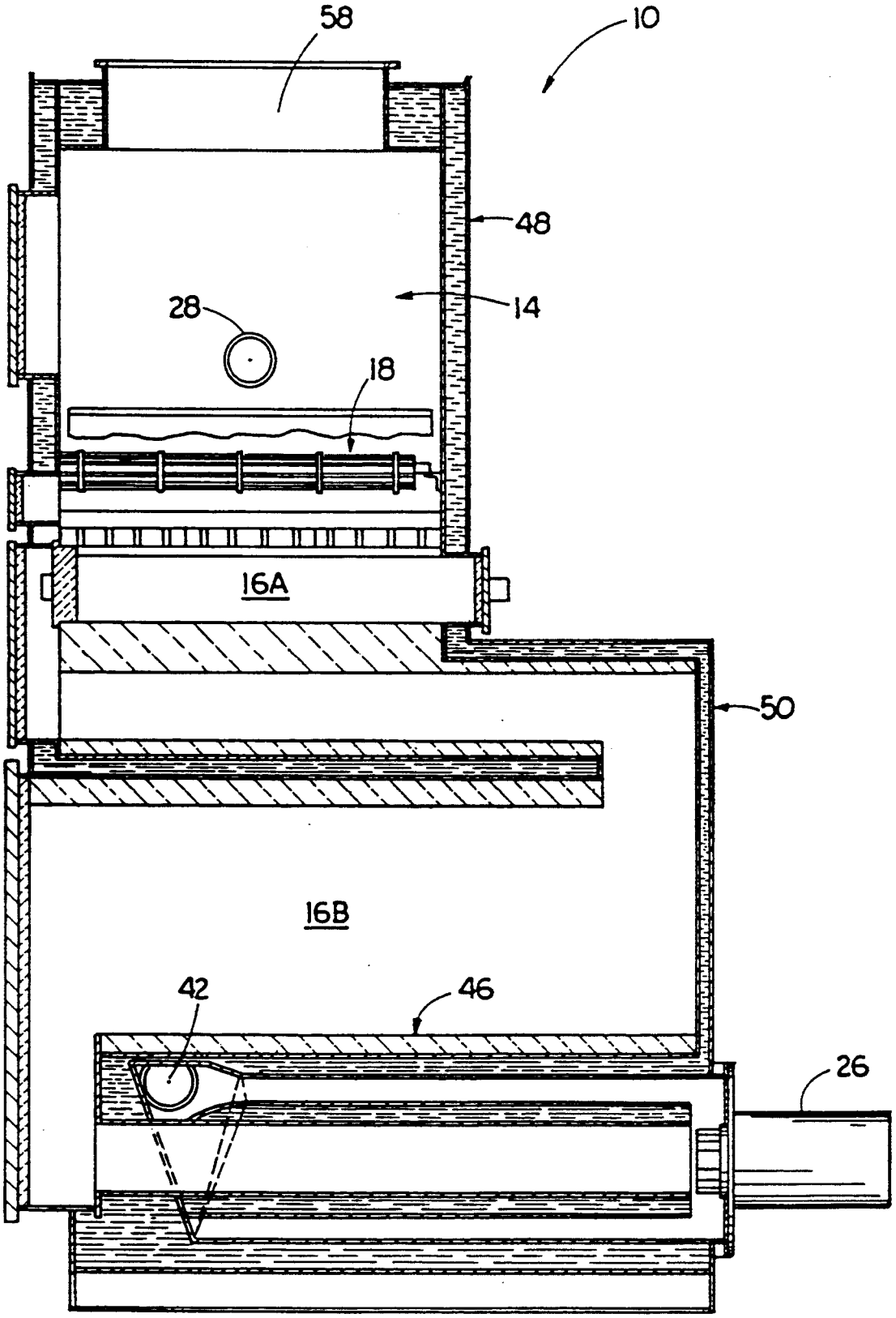
FIG. 22 is a longitudinal vertical sectional view of a modified embodiment of the apparatus.

For many applications, the material processing apparatus 10 can be provided in the form of a single unit where all components of the apparatus are contained within the one unit. However, in order to accommodate space and installation requirements, there are other applications where the material processing apparatus 10 needs to be provided in the form of two separate first and second units 48, 50, as shown in FIGS. 1–12. For example, in some hospital sites, the provision of the apparatus 10 as two separate units 48, 50 permits the apparatus 10 to be transported through existing doorways and hallways and installed in existing rooms. FIGS. 1–12 illustrate an embodiment of the apparatus 10 wherein the first and second units 48, 50 are disposed in end-to-end relation to one another. FIG. 22 illustrates another embodiment of the apparatus 10 wherein the first and second units 48, 50 are disposed one (first) unit 48 above the other (second) unit 50.

Figure 23:
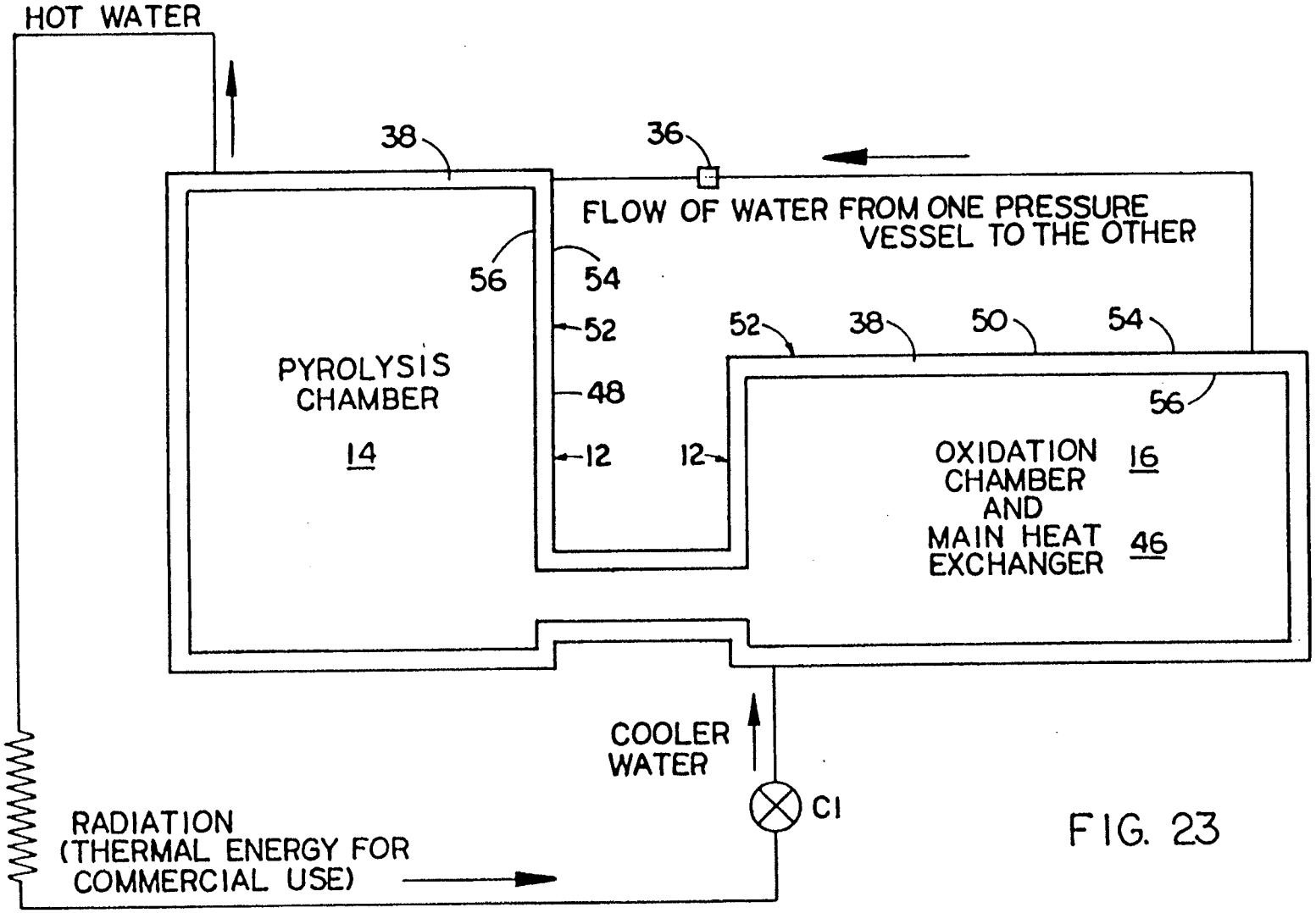
FIG. 23 is a block diagram of a coolant fluid circulation circuit employed by the apparatus of FIG. 1.

Referring to FIGS. 1–12, the material processing apparatus 10 includes a casing 52 having outer and inner spaced walls 54, 56 forming the coolant jacketed airtight pressure vessel 12 inside of the inner wall 56 and the channel 38 between the outer and inner walls 54, 56. The channel 38 surrounds the vessel 12 and contains the flow of coolant fluid, such as water. FIG. 23 illustrates an example of the circulation flow path of the coolant fluid about the vessel channel 38 and between the first and second units 48, 50 of the vessel 12. As mentioned above, the vessel 12 of the apparatus 10 is separated into first and second units 48, 50 and has means in the form of a pair of tubular extensions 54A, 56A of the outer and inner walls 54, 56 which are fastened together to interconnect the first and second units 48, 50 in flow communication with one another.

Referring to FIGS. 7–11, the vessel 12 defines the first pyrolysis chamber 14 having an inlet 58 and the second oxidation chamber 16 connected in communication with the first pyrolysis chamber 14 and having the discharge outlet 42. The first chamber 14 in which the materials will be pyrolyzed receives the materials through the inlet 58 via operation of an automatic feeding system 59 (FIG. 24). The first chamber 14 of the vessel 12 for pyrolyzing materials is disposed in the first unit 48. The material, through pyrolysis, or burning in a starved oxygen atmosphere, is converted to a gas that exits the first chamber 14 by passing down through holes 60 in fire brick 62 in the bottom of the first chamber 14 and therefrom to the second chamber 16.

The second chamber 16 receives the pyrolyzed materials from the first chamber 14 and, after oxidizing the pyrolyzed materials therein, discharges the oxidized materials therefrom through the discharge outlet 42. The second chamber 16 has primary and secondary sections 16A, 16B for oxidizing materials in two successive stages. The primary section 16A is disposed in the first unit 48 of the vessel 12 between the first chamber 14 and the tubular extensions 54A, 56A. The secondary section 16B is disposed in the second unit 50 of the vessel 12.

The primary section 16A of the second chamber 16 contains a series of serpentine passages or tunnels 64, 66, 68 defined in a mass 70 of refractory material contained in the first unit 48. The gas passes in one direction through the center tunnel 64 which is plugged at one end, then in reverse direction toward the rear of the first unit 48 to a rear manifold 72, then splits into two gas flows and again reversing in direction to pass toward the front of the first unit 48 through the opposite side tunnels 66, 68 (on the opposite sides of the plugged center tunnel 64), and then to a front manifold 74 where the oxidized gas passes down to a lower tunnel 76.

The secondary section 16B of the second chamber 16 is located in the second unit 50. The oxidized gas from the primary section 16A of the second chamber 16 flows through the lower tunnel 76 in a direction toward the rear of the first unit 48, through the tubular extensions 54A, 54B, and into the secondary section 16B in the second unit 50. The secondary section 16B has a series of spaced air flow baffles 78 with offset openings 80 extending across the flow path of air through secondary section 16B.

The heat exchanger 46 is also located in the second unit 50 above the secondary section 16B of the second chamber 16. The upper heat exchanger 46 has the induction fan 26 connected at one end which operates to draw the gases from the first chamber 14 down through the fire brick 62 into the primary section 16A of the second chamber 16. The gases then flow through the tunnels 64, 66, 68 of the primary section 16A, back through the secondary section 16B of the second chamber 16, then up and forwardly through the center of the heat exchanger 46 to the center of the induction fan 26 which then forces the exhaust gas outwardly and rearwardly around and along the heat exchanger 46 for exiting through discharge outlet 42 into a wet scrubber 82 (FIG. 24). The exhaust gas is virtually free of any pollution and the original material has been almost completely oxidized so that only a very small amount of fine minute dust or powder particles are collected in a particle separator (not shown).

Heat Generator Assembly

Referring to FIGS. 1, 7–9, 13–21, 23 and 24, there is illustrated a pair of heat generator assemblies 84 incorporated in the first chamber 14 of the apparatus 10. The heat generator assemblies 84 are mounted horizontally through the first chamber 14 and adjacent opposite side portions of the inner wall 56 of the casing 52. Each heat generator assembly 84 includes the first heater unit 18 and an elongated deflector structure 86 mounted adjacent to and along the electric heating elements 20 of the first heating unit 18. The first heater unit 18 is mounted to the vessel 12 and extends horizontally into the first chamber 14 between opposite ends thereof and along one of the opposite sides thereof. The first heater unit 18 is powered by a power controller 87 (FIG. 24) which, in turn, is powered by an electrical power supply (not shown) and controlled by the computer-based control system 44 for producing heating of materials received in the first chamber 14 to cause pyrolyzing of the materials into gases. One suitable embodiment of the power controller 87 is a commercially-available unit identified as SSR2400C90 marketed by Omega Engineering of Stanford, Conn. The plurality of elongated electric heating elements 20 extend in generally parallel relation to one another and are constructed of electrically-resistive material operable for emitting heat radiation. The deflector structure 86 extends in circumferential relation partially about the electric heating elements 20 so as to deflect the heat radiation in a desired direction away from the electric heating elements 20 and from the adjacent side of the first chamber 14.

Referring to FIGS. 13–21, in addition to the electric heating elements 20, each first heater unit 18 includes an elongated support member 88 having spaced opposite end portions 88A, 88B, a pair of elongated electrically-conductive positive and negative electrodes 90, 92 each having spaced opposite end portions 90A, 90B and 92A, 92B, and an electrically insulative cylindrical mounting body 94 sealably mounted through the outer and inner walls 54, 56 at the front of the first unit 48 of the casing 52 and supporting the support member 88 and electrodes 90, 92 at corresponding ones of the opposite end portions 88A, 90A, 92A thereof so as to position the support member 88 and electrodes 90, 92 in spaced apart and substantially parallel relation to one another. The one end portions 90A, 92A of the positive and negative electrodes 90, 92 project from the exterior of the front of the casing 52 such that they can be electrically connected to the power supply (not shown) and the control system 44.

Each first heater unit 18 further includes a plurality of spacer elements 96, in the form of electrically-insulative circular discs 96, supported along the support member 88 in spaced relation from one another. The support member 88 includes an elongated rod 98 and a plurality of ceramic sleeves 100 inserted over the rod 98. The sleeves 100 are disposed between the spacer discs 96, positioning them in the desired spaced relationship. The ceramic sleeves 100 and spacer discs 96 are maintained in the desired assembled condition by nuts 102 tightened on the threaded opposite end portions 98A, 98B of the elongated rod 98 of the support member 88. The one end portion 98A of the rod 98 extends through and is supported by the cylindrical mounting body 94, while the other end portion 98B of the rod 98 is supported upon a bracket 104 fixed on the inner wall 56 at a rear end of the first unit 48 of the casing 52.

The spacer discs 96 support the elongated electric heating elements 20 and positive and negative electrodes 90, 92 at spaced locations therealong so as to position the electric heating elements 20 in spaced apart and substantially parallel relation to one another and to the positive and negative electrodes 90, 92 and in an arcuate configuration between the positive and negative electrodes 90, 92 and offset from the support member rod 98. Each spacer disc 96 has an array of holes 106 arranged in asymmetrical relation to a center C of the disc permitting the passage therethrough of the positive and negative electrodes 90, 92 and the electric heating elements 20. Preferably, the electric heating elements 20 and electrodes 90, 92 are spaced along about a first 180° arc of a circle defined about center of C of the disk 96. Also, the elongated support member 88 extends through an aperture 107 in each spacer disk 96 being offset from the center c of the disc 96 and located at the center of a second 180° arc of the circle defined about the center C. In such manner, the heat energy radiated by the electric heating elements 20 is concentrated and directed on the material and not on the portion of the inner wall 56 of the casing 52 adjacent to the heater unit 18.

The first heating unit 18 also includes means in the form of a plurality of short rod-like connector elements 108 made of electrically-conductive material which electrically connects selected ones of the opposite end portions 20A, 20B of the electric heating elements 20 with selected ones of the opposite end portions 90A, 90B and 92A, 92B of the positive and negative electrodes 90, 92 so as to define an electrical circuit path, having a substantially serpentine configuration, between the positive and negative electrodes 90, 92 and through the electric heating elements 20. The rod-like connector elements 108 are interspaced between and rigidly attached to the selected ones of the opposite end portions of the electric heating elements 20 and the positive and negative electrodes 90, 92.

Each of the second heater units 22 employed in the secondary section 16B of the second chamber 16 has substantially the same construction and configuration as the first heater unit 18 described above with one difference. The difference is that the electric heating elements 24 of the second heater unit 22 are distributed and spaced about the full circle instead of only about one-half of the circle. The second heater units 22 are also powered by another power controller 87.

Thus, the first heater units 18 in the first chamber 14 are specifically designed and positioned so that the electric heating elements 20 are disposed away from the side portions of the inner wall 54 of the vessel 12. The deflector structure 86 associated with each first heater unit 18 serves to deflect the flow of gases away from the electric heating elements 20 and thus protect them from damage and also serve to direct the heat radiated by the electric heating elements 20 away from the inner wall 56. The deflector structure 86 includes a planar mounting plate 110 attached to the adjacent side portion of the inner wall 56, an arcuate shield 112 extending along the mounting plate 110, and means in the form of one or more braces 114 rigidly attaching the arcuate shield 112 along the mounting plate 110. The arcuate shield 112 overlies and surrounds approximately the upper one-third, or 120°, of the circular heater unit 18.

Casing And Heater Configuration

Referring to FIGS. 1, 5–7 and 12, as described earlier the second unit 50 of the casing 52 includes therein the lower secondary section 16B of the second chamber 16 and the upper heat exchanger 46. Also, the secondary section 16B of the second chamber 16 includes a plurality, for example three, of the second heater units 22 and the baffles 78.

In order to provide access from the exterior of the casing 52 for mounting the second heater units 22 through spaced side portions of the outer and inner walls 54, 56 of the casing 52 and within the second chamber 16, the outer wall 54 of the second unit 50 of the casing 52 has a unique configuration. The outer wall 54 has a substantially one-sided figure eight configuration so as to accommodate positioning of the second heater units 22 through the spaced side portions of the outer and inner walls 54, 56 of the casing 52 to extend across the second chamber 16 in orientations positioned intermediately, such as about 45°, between vertical and horizontal orientations.

Further, in the second unit 50 the inner wall 56 of the casing 52 is provided in the form of a plurality of upper inner walls 116, 118, 120, 122 having substantially concentric cylindrical configurations, and a lower inner wall 124. The concentric upper inner walls 116, 118, 120, 122 define an upper airtight portion of the vessel 12 which, in turn, defines the heat exchanger 46. The lower inner wall 124 defines a lower airtight portion of the vessel 12 which contains the secondary section 16B of the second chamber 16. An inner manifold 126 is defined at the rear end of the second unit 50 of the casing 52 between the outer wall 54 and the rear end portions of the concentric inner walls 116, 118, 120, 122 so as to provide extension 38A of the channel 46 into the heat exchanger 46 for providing flow communication of the coolant through the heat exchanger 46. An outer manifold 128 is defined also at the rear end of the second unit 50 of the casing 52 for providing flow communication of gases from the secondary section 16B of the second chamber 16 through the heat exchanger 46 to the discharge outlet 42.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

Claims

1. A heat generator assembly, comprising:

(a) a pair of elongated electrically-conductive positive and negative electrodes each having spaced opposite end portions;

(b) a plurality of elongated electric heating elements each having spaced opposite end portions and being constructed of electrically-resistive material operable for emitting heat radiation; and means for supporting said positive and negative electrodes and said electric heating elements in spaced apart and substantially parallel relation to one another between said respective opposite end portions thereof; said supporting means including (i) an elongated support member having spaced opposite end portions, and (ii) a plurality of spacer elements supported along said support member in spaced relation from one another between said opposite end portions thereof, said spacer elements supporting said positive and negative electrodes and said elongated electric heating elements at spaced locations between said opposite end portions thereof so as to position said positive and negative electrodes and said electric heating elements in spaced apart and substantially parallel relation to one another between said opposite end portions thereof, (iii) each of said spacer elements being an electrically-insulative disc having a center, an array of holes arranged in asymmetrical relation to said center and permitting passage therethrough of said positive and negative electrodes and said electric heating elements and an aperture offset from said center away from said array of holes and permitting passage therethrough of said elongated support member; and (d) means for electrically connecting selected ones of said opposite end portions of said electric heating elements with selected ones of said opposite end portions of said positive and negative electrodes so as to define at least one electrical circuit path between said positive and negative electrodes and through said electric heating elements.

2. The assembly as recited in claim 1, wherein said connecting means includes a plurality of connector elements interspaced between and rigidly attached to said selected ones of said opposite end portions of said electric heating elements and said positive and negative electrodes.

3. The assembly as recited in claim 1, wherein said electrical circuit path defined by said connecting means between said positive and negative electrodes and through said electric heating elements has a substantially serpentine configuration.

4. The assembly as recited in claim 1, wherein said supporting means includes an electrically-insulative mounting body supporting said elongated support member and said elongated electrodes at corresponding ones of said opposite end portions thereof so as to position said support member and electrodes in spaced apart and substantially parallel relation to one another between said respective opposite end portions thereof.

5. The assembly as recited in claim 4, wherein said connecting means includes a plurality of connector elements interspaced between and rigidly attached to said selected ones of said opposite end portions of said electric heating elements and said positive and negative electrodes.

6. The assembly as recited in claim 5, wherein said electrical circuit path defined by said connecting means between said positive and negative electrodes and through said electric heating elements has a substantially serpentine configuration.

7. A heat generator assembly, comprising:

(a) a heater unit including an elongated support member, a plurality of elongated electric heating elements being operable for emitting heat radiation, and a pair of elongated electrically-conductive positive and negative electrodes, said electric heating elements and said positive and negative electrodes extending in generally parallel relation to one another, said electric heating elements being disposed in an arcuate configuration between said positive and negative electrodes and offset from said support member; and (b) an elongated deflector structure means for mounting adjacent to and along said electric heating elements and said positive and negative electrodes and in circumferential relation partially thereabout for deflecting said heat radiation in a desired direction away from said elements.

8. The assembly as recited in claim 7, wherein said deflector structure includes:

a planar mounting plate;

an arcuate shield extending along said plate; and means for rigidly attaching said shield to said mounting plate.

9. The assembly as recited in claim 7, wherein said heater unit further includes an electrically-insulative mounting body supporting said elongated support member and said elongated electrodes at corresponding ones of said opposite end portions thereof so as to position said support member and electrodes in spaced apart and substantially parallel relation to one another between said respective opposite end portions thereof.

10. The assembly as recited in claim 7, wherein said heater unit further includes a plurality of spacer elements supported along said support member in spaced relation from one another between said opposite end portions thereof, said spacer elements supporting said elongated electric heating elements at spaced locations between said opposite end portions thereof so as to position said electric heating elements in spaced apart and substantially parallel relation to one another between said opposite end portions thereof and in said arcuate configuration between said positive and negative electrodes and offset from said support member.

11. The assembly as recited in claim 10, wherein each of said spacer elements is an electrically-insulative disc having a center, an array of holes arranged in asymmetrical relation to said center of said disc and permitting passage therethrough of said positive and negative electrodes and said electric heating elements, and an aperture offset from said center away from said array of holes and permitting passage therethrough of said elongated support member.

12. The assembly as recited in claim 10, wherein said deflector structure includes:

a planar mounting plate;

an arcuate shield extending along said plate; and means for rigidly attaching said shield to said mounting plate.

13. The assembly as recited in claim 10, wherein said heater unit further includes means for electrically connecting selected ones of said opposite end portions of said electric heating elements with selected ones of said opposite end portions of said positive and negative electrodes so as to define at least one electrical circuit path between said positive and negative electrodes and through said electric heating elements.

14. The assembly as recited in claim 13, wherein said connecting means includes a plurality of connector elements interspaced between and rigidly attached to said selected ones of said opposite end portions of said electric heating elements and said positive and negative electrodes.

15. The assembly as recited in claim 13, wherein said deflector structure includes:

a planar mounting plate;

an arcuate shield extending along said plate; and means for rigidly attaching said shield to said mounting plate.

* * * * *